United States Patent [19]

Kohlman et al.

[11] Patent Number: 4,771,973

[45] Date of Patent: Sep. 20, 1988

[54] BLEACHER BALL BRACKET

[76] Inventors: Dennis M. Kohlman, 526 S. River St.; Thomas G. Ashworth, 720 N. 38th St., both of Sheboygan, Wis. 53081

[21] Appl. No.: 72,413

[22] Filed: Jul. 13, 1987

[51] Int. Cl.[4] ..... A47B 96/06

[52] U.S. Cl. ..... 248/229; 248/231.7; 248/316.6; 273/1.5 R; 403/388

[58] Field of Search ..... 248/231.7, 316.4, 316.6, 248/316.1, 227, 229, 215, 205.1, 228; 273/1.5 R; 297/252; 211/87; 403/388, 393; 52/9

[56] References Cited

U.S. PATENT DOCUMENTS

| | | | |
|---|---|---|---|
| 2,841,207 | 7/1958 | Sweeney | 297/252 |
| 2,875,974 | 3/1959 | Albert | 248/229 |
| 2,950,836 | 8/1960 | Murdock | 248/229 X |
| 2,993,254 | 7/1961 | Larson | 403/393 X |
| 3,180,605 | 4/1965 | Ewaskowitz | 248/231.7 |
| 3,768,215 | 10/1973 | Raymond et al. | 52/9 |
| 4,082,269 | 4/1978 | Hill | 273/1.5 R |

FOREIGN PATENT DOCUMENTS

| | | | |
|---|---|---|---|
| 689312 | 4/1965 | Italy | 273/1.5 R |

*Primary Examiner*—David L. Talbott
*Attorney, Agent, or Firm*—Donald Cayen

[57] ABSTRACT

A bleacher ball bracket enables a basketball hoop to be temporarily but rigidly mounted at a height appropriate to a player's ability. The ball bracket comprises a J-shaped plate that rests on a bleacher seat. The plate hooked end engages the back edge of bleacher seat and is retained thereon by thumb screws, with the long leg of the plate overhanging the bleacher seat front edge. The ball bracket includes dogs that clamp the horizontal mounting leg of a conventional basketball hoop to the overhanging end of the bracket plate with the hoop vertical mounting leg firmly against the bleacher seat front edge, thereby mounting the hoop to the bleacher seat. When the bleachers are closed, the vertical front surface thereby created serves as a backboard for the hoop.

14 Claims, 3 Drawing Sheets

BLEACHER BALL BRACKET

BACKGROUND OF THE INVENTION

1. Field of the Invention

This invention pertains to sports equipment, and more particularly to apparatus for assisting young athletes shoot balls through a hoop.

2. Description of the Prior Art

The game of basketball is universally known and played. Persons of all ages and abilities enjoy the challenge of shooting balls through an elevated hoop.

A disadvantage of the conventional rules of basketball is that the hoop is placed at a fixed height of ten feet above the playing surface. While that height contributes to the enjoyment and challenge of older players, it is also a source of frustration to young children. Merely heaving the ball to within the vicinity of the high hoop requires major effort on the part of youngsters. Consequently, young players acquire numerous bad habits and techniques in their continuous attempts to force the ball upwardly through distances that are disproportionate to their abilities. In addition, the children rarely succeed in making baskets, thereby leading to discouragement.

Another deficiency of conventional basketball playing arrangements is that the hoops are usually fixedly located within a gymnasium or outdoor court. While such fixed locations are perfectly satisfactory for organized play by older persons, the lack of flexibility is detrimental to physical education classes involving young students. Efficient instruction requires a number of hoops and backboards to accommodate a class of students.

Various equipment has been developed to provide hoops and backboards on a temporary basis to physical education classes. For example, portable hoops and backboards mounted on various types of posts and bases are known. However, such devices have the drawback of being heavy, expensive, unstable, and bulky to store. It is also known to mount hoops and backboards on a vertical track fixed to a building wall. Electric motors are used to move the hoops and backboards up and down on the track. The expense of such an arrangement is apparent.

Thus, a need exists for convenient and inexpensive equipment that assists children acquire basketball playing skills.

SUMMARY OF THE INVENTION

In accordance with the present invention, versatile athletic equipment is provided that is readily adaptable to match the difficulty of basketball shooting to a player's age and skill. This is accomplished by apparatus that includes a sturdy ball bracket designed to rigidly retain a conventional basketball hoop on gymnasium bleachers.

The ball bracket comprises a generally J-shaped plate having an elongated flat and straight first end and a hooked second end. The hooked end is adapted to engage the back edge of a seat on conventional gymnasium bleachers with the bracket first end resting on the top of the seat and overhanging the seat front edge.

A conventional basketball hoop is attachable to the plate first end. Attachment is preferably by means of a pair of dogs that are designed to clamp a hoop mounting member between the bracket plate and the dogs. In one embodiment of the invention, the spread between the dogs longitudinally along the plate is adjustable, thereby permitting different length hoop mounting members to be clamped with maximum leverage. Clamping force is achieved by means of conventional fasteners between the dogs and plate.

To retain the bracket and hoop sturdily in place on a bleacher seat, the plate hooked end is provided with thumb screws that bear against the seat undersurface. Damage to the bleachers is avoided by the use of soft protective pads at the points of contact of the bracket with the bleacher seat and also with the bleacher riser component immediately above the seat.

In use, the gymnasium bleachers are pulled from the gym wall to the open configuration. The ball bracket is placed on top of a selected bleacher seat, with the hooked end engaging the seat. With the plate resting on the seat top surface and the hoop loosely positioned, the thumb screws are firmly tightened. The hoop is then snugged up to the front edge of the bleacher seat, and the dogs are firmly clamped to the plank by tightening the fasteners. The bleachers are then pushed back against the gym wall to the closed configuration. The result is a hoop that protrudes from the front vertical surface of the folded bleachers at the selected height and at the same horizontal distance a hoop extends from the front face of a conventional backboard. The folded bleachers therefore act as the backboard. After use, the bleachers are opened. The bleacher ball bracket thumb screws are loosened, and the bracket and hoop are removed from the bleacher seat for convenient storage as a unit. Removal is easily accomplished by tilting the bracket and hoop upwardly, or simply by sliding the bracket off the end of the bleacher seat.

Other aims and advantages of the invention will become readily apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
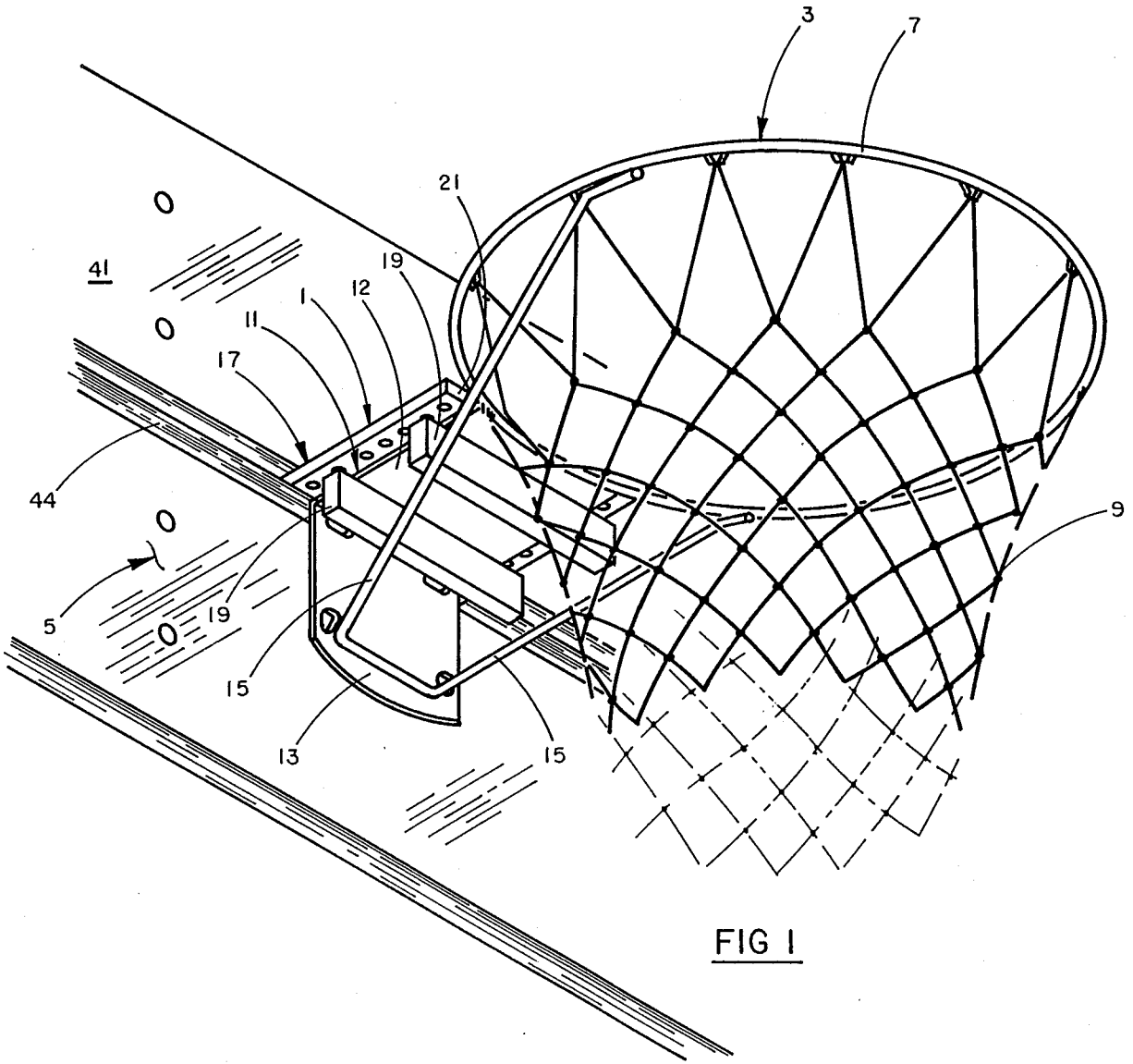
FIG. 1 is a perspective view of the bleacher ball bracket of the present invention in place on gymnasium bleachers.
Figure 2:
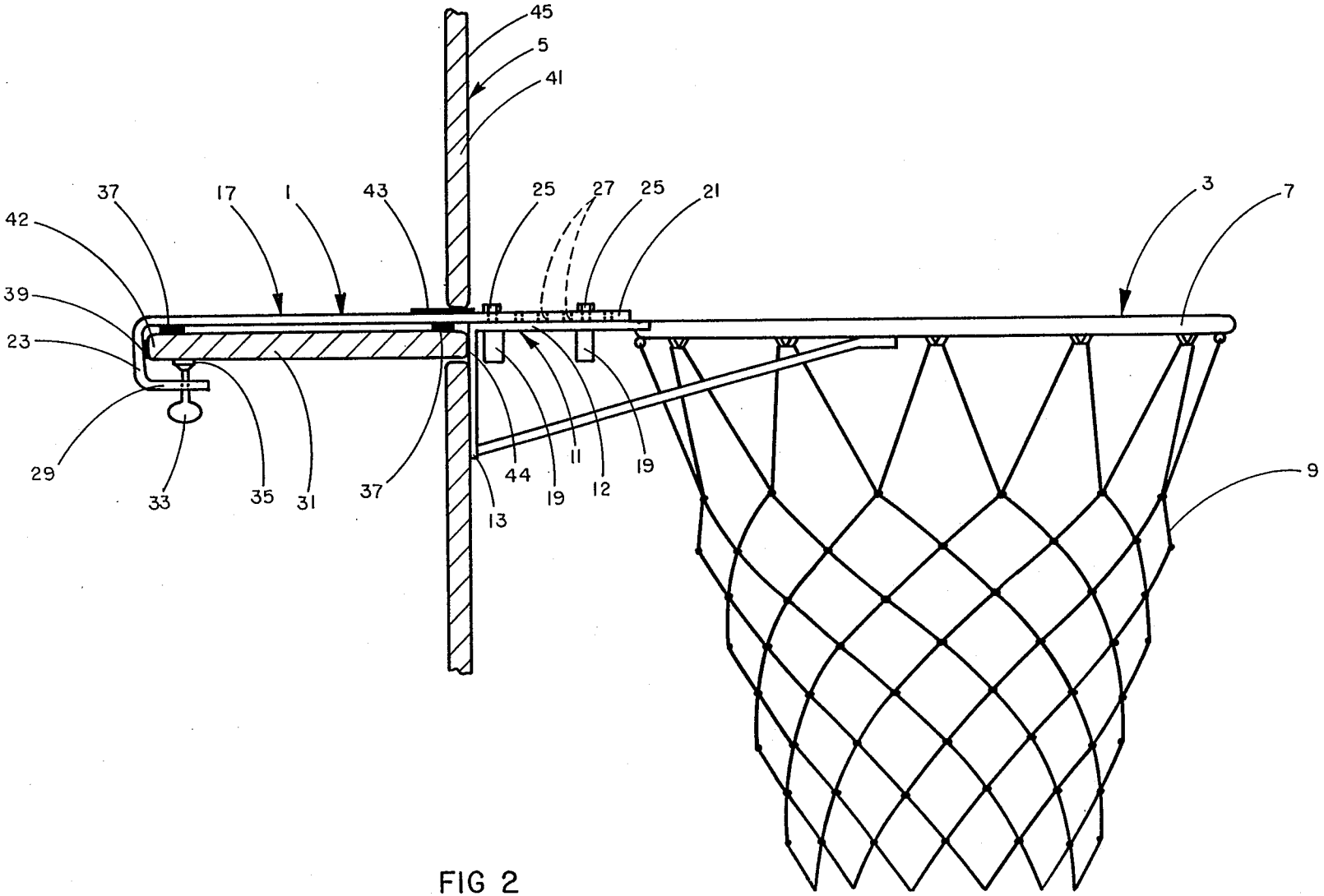
FIG. 2 is a side view of the bleacher ball bracket of the present invention installed on a bleacher seat.
Figure 3:
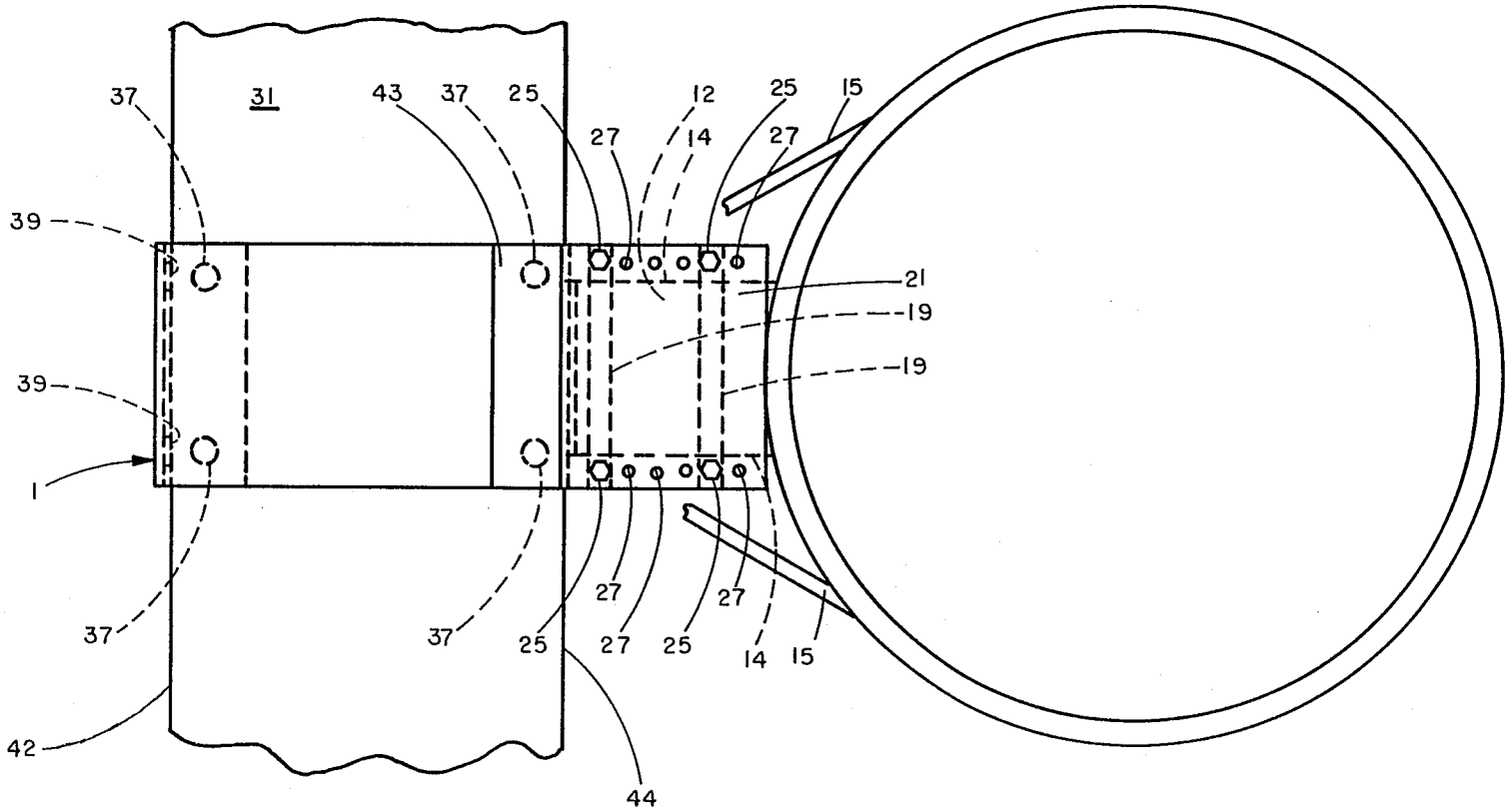
FIG. 3 is a top view of the bleacher ball bracket shown in place on a bleacher seat.

Referring to FIGS. 1–3, a ball bracket 1 is illustrated that includes the present invention. The ball bracket is particularly useful for mounting a conventional basketball hoop 3 to gymnasium bleachers 5, but it will be understood that the invention is not limited to indoor sports use.

The basketball hoop 3 has the usual ring 7 from which is suspended a rope-like net 9. Welded to the ring 7 so as to be coplanar therewith is a horizontal leg 12 of a right angle mounting member 11. Depending from the mounting member horizontal leg 12 is a vertical leg 13. A pair of struts 15 brace the ring on the vertical leg 13.

In accordance with the present invention, the ball bracket 1 enables the placement of the hoop 3 at a wide variety of locations on the seats of conventional bleachers 5. For that purpose, the ball bracket comprises a rigid plate 17 and a pair of dogs 19. The plate 17 has a flat elongated first end 21 and a second end 23 that is shaped into a hook, thereby giving a generally J-shape to the plate.

The dogs 19 extend transversely to the plate 17 and are employed to clamp the horizontal leg 12 of the hoop mounting member 11 against the underside of the bracket first end 21. Clamping is accomplished by means of fasteners 25 that pass through clearance holes 27 in the plate and mate with tapped holes in the dogs. As best seen in FIG. 3, the clearance holes 27 lie outboard of the lateral edges 14 of the hoop horizontal leg 12. To permit the ball bracket 1 to accommodate hoops with different length horizontal legs and different widths of bleacher seats, the plate first end 21 contains a series of clearance holes that provide adjustability for the location of the dogs.

The ball bracket hooked end 23 may be fabricated by bending the second end of the plate 17. Alternately, the hook may be fabricated as separate pieces that are welded together. The spread between the planes of the bracket first end 21 and the hook end leg 29 is preferably about 1.75 inches. (See FIG. 2.) That dimension is sufficient to accept and engage the seat portion 31 of the bleachers 5. To rigidly but temporarily retain the ball bracket 1 on the bleacher seat 31, a pair of thumb screws 33 with large-faced nuts 35 may be employed. The nuts 35 are preferably permanently joined to the thumb screw threads, as by an adhesive. To eliminate scoring the underside of the bleacher seat when the screws 33 are tightened, a layer of soft plastic material is bonded to the flat faces of the nuts 35. Further, the tops and backs of the bleacher seat are protected from the heavy bracket of the present invention by felt or other soft pads 37 and 39, respectively. To protect the lower edge of the bleacher riser 41 immediately above the seat, the upper surface of the plate 17 is provided with a relatively large pad 43.

We have found that an overall length of approximately 16 inches for the plate 17 is satisfactory, together with a width of approximately 6 inches. The preferred spacing between the holes 27 is approximately 1 inch.

To use the bleacher ball bracket 1 of the present invention, the hoop horizontal leg 12 is clamped between the underside of the ball bracket plate first end 21 and the dogs 19. The holes 27 for the screws 25 are chosen so that the longitudinal spread between the dogs is a maximum for the particular hoop 3. Once the hoop is clamped to the ball bracket, it need not be removed. With the bleachers 5 in the open configuration, a seat 31 is chosen that is the correct height for the players that will use the hoop. The thumb screws 33 are fully loosened. The bracket and hoop are tilted counterclockwise with respect to FIG. 2, with the hook 23 adjacent the back edge 42 of the bleacher seat. As the bracket and hoop are rotated clockwise to the horizontal attitude of FIG. 2, the bracket and hoop are pulled to the right until the plate hook 23 fully engages the bleacher seat. With the bracket plate 17 at rest against the top surface and back edge 42 of the seat, the pads 37 and 39 protect the seat from the bracket. Depending on the width of the seat, the position of the hoop vertical leg 13 on the bracket may require adjustment. Such adjustment is easily performed by loosening the screws 25 and possibly choosing another pair of holes 27 for the dogs 19 or by sliding the hoop snugly against the bleacher. It is desirable that the hoop vertical leg 13 be closely adjacent the bleacher seat front edge 44.

With the ball bracket 1 firmly retained in place with the thumb screws 33, the bleachers 5 are pushed to the closed configuration. The bleacher riser section 41 above the ball bracket is protected by the pad 43. The hoop 3 extends from the front vertical surface 45 of the folded bleachers in a manner that is substantially identical to a hoop extending from a conventional backboard. With the ball bracket of the present invention, the bleacher front vertical surface 45 above the hoop serves as the backboard. The ball bracket may, of course, be mounted to the top seat of the bleacher if desired. In that case, the hoop would not have a backboard. When the game or physical education class is over, the bleachers are unfolded sufficiently to give access to the thumb screws. Loosening the thumb screws fully and tilting the bracket and hoop counterclockwise as viewed in FIG. 2 disengages the bracket from the seat 31 or sliding the bracket off the end of the seat for convenient storage.

Thus, it is apparent that there has been provided, in accordance with the invention, a bleacher ball bracket which fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A bleacher ball bracket comprising:

a. a generally J-shaped plate having an elongated flat first end with opposed top and bottom surfaces and a hooked second end, the plate being dimensioned such that the hooked end is engagable with the back edge of a selected flat seat with the first end bottom surface in close proximity to and overhanging the seat;

b. at least one dog fabricated as an elongated bar of rigid material and extending transversely to the plate first end in close proximity thereto, the dog and plate first end cooperating to removeably receive a basketball hoop mounting member therebetween; and c. fastening means for releasably securing the dog to the plate first end to thereby permit removeably clamping the basketball hoop mounting member between the dog and the plate, so that the basketball hoop may be mounted to the selected seat.

2. The bleacher ball bracket of claim 1 further comprising a relatively large protective pad secured to the bracket plate first end on the top surface thereof and arranged to protect a member vertically above the seat to which the bracket and hoop are mounted.

3. The bleacher ball bracket of claim 1 wherein the plate first end defines adjustment means for adjusting the location of the dogs on the plate to thereby accommodate different size hoop mounting members and different widths of flat seats for clamping to the plate.

4. In combination with a basketball hoop having a ring and a mounting leg attached thereto and coplanar therewith, a bleacher ball bracket comprising:

a. a generally J-shaped plate having an elongated flat first end in facing contact with the hoop mounting leg and a hooked second end adapted to engage the back edge of a selected flat seat; and b. clamp means for cooperating with the plate to releasably clamp the hoop mounting leg to the plate first end to thereby enable the hoop to be mounted to the seat, wherein:

i. the clamp means comprises at least one dog releasably fastened to the plate first end, the dog being fabricated as an elongated bar of rigid material adapted to clamp the hoop mounting leg between the dog and the plate; and ii. the plate first end defines adjustment means for adjusting the location of the dog relative to the plate and hoop mounting leg to thereby accommodate different size hoop mounting legs and different widths of flat seats.

5. The combination of claim 4 further comprising first and second protective pads attached to the plate first and second ends, respectively, the first pads being arranged and located to protect a selected member vertically adjacent and above the plate first end, the second pads being arranged to separate and protect the seat from the bleacher ball bracket.

6. In combination with bleachers that convert between folded and unfolded configurations, the bleachers forming a substantially vertical front surface when in the folded configuration, apparatus for use by persons playing a ball game comprising:

a. a ring having a diameter sufficient for permitting a ball to pass therethrough;

b. a mounting leg joined to and generally coplanar with the ring; and c. a ball bracket adapted to mount on a selected bleacher seat and to rigidly maintain the ring in a generally horizontal plane adjacent the closed bleachers vertical surface, the ball bracket comprising:

i. a generally J-shaped plate having an elongated flat first end for resting on the selected bleacher seat and overhanging the front edge thereof and having a hooked second end adapted to engage the back edge of the bleacher seat;

ii. at least one dog removeably secured to the ball plate first end at the portion thereof that overhangs the front edge of the bleacher seat, the dog being fabricated as an elongated bar of rigid material and adapted to cooperate with the plate first end to clamp the ring mounting leg therebetween; and iii. retaining means in the plate second end for releasably mounting the ball bracket to the bleacher seat, so that when the bleachers are in the folded configuration a vertical front surface thereof above the ring forms a backboard for the ring.

7. The combination of claim 6 further comprising:

a. first pad means for protecting the bleacher seat top surface and back edge from the ball bracket; and b. second pad means for protecting the bleacher riser adjacent and above the ball bracket therefrom.

8. The combination of claim 6 wherein the ball bracket plate first end defines adjustment means for adjusting the location of the dogs to enable the ball bracket to clamp different size ring mounting legs thereto and to accommodate different widths of bleacher seats.

9. A bleacher ball bracket comprising:

a. a generally J-shaped plate having a flat elongated first end and a hooked second end;

b. at least one dog fabricated as an elongated bar of rigid material extending transversely under the plate first end;

c. fastening means extending through the plate first end and mating with the dog for enabling a first selected member to be releasably clamped between the plate and dog;

d. screw means threaded into the plate hooked end for releasably retaining the bleacher ball bracket to a horizontally oriented second selected member with the plate first end in facing contact with the second selected member and the plate second end in hooked engagement with the second selected member; and e. pad means attached to the plate first and second ends for protecting the second selected member from damage when the bleacher ball bracket is mounted thereto.

10. The bleacher ball bracket of claim 9 wherein the plate first end defines means for adjusting the position of the dogs relative to the plate first end for enabling the dogs and plate to clamp therebetween a variety of different sized first and second selected members.

11. The bleacher ball bracket of claim 10 wherein:

a. the second selected member is a flat seat; and b. the bleacher ball bracket plate first end and the dogs fastened thereto overhang the seat.

12. A method of mounting a basketball hoop having a horizontal leg at a selected height above a playing surface comprising the steps of:

a. providing a bleacher ball bracket having a generally J-shaped plate with a flat elongated first end and a hooked second end and at least one dog releasably fastened to the plate first end, the dog being fabricated as an elongated bar of rigid material;

b. clamping the hoop horizontal leg to the bleacher ball bracket plate first end by means of the dog;

c. engaging a selected bleacher seat with the bleacher ball bracket hooked end and placing the bleacher ball bracket first end on the bleacher seat top surface;

d. retaining the bleacher ball bracket hooked end to the bleacher seat; and e. folding the bleachers to the closed configuration, so that the basketball hoop extends horizontally from the vertical surface of the folded bleachers.

13. The method of claim 12 further comprising the step of tilting the bleacher ball bracket and hoop at an angle above the selected bleacher seat prior to engaging the bleacher seat with the bleacher ball bracket hooked end.

14. The method of claim 12 further comprising the step of adjusting the position of the dogs on the bleacher ball bracket to locate the hoop at a horizontal extension relative to the folded bleachers vertical surface that corresponds to the extension of the hoop from a conventional basketball backboard.

* * * * *